US006468100B1

(12) United States Patent
Meyer et al.

(10) Patent No.: US 6,468,100 B1
(45) Date of Patent: Oct. 22, 2002

(54) BMA INTERCONNECT ADAPTER

(75) Inventors: Daniel B. Meyer, Lake Oswego, OR (US); William R. Pooley, Aloha, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/866,347

(22) Filed: May 24, 2001

(51) Int. Cl.[7] ..... H01R 4/38
(52) U.S. Cl. ..... 439/320; 439/312
(58) Field of Search ..... 439/312, 320, 439/321, 323, 578, 583, 584, 585, 248, 247

(56) References Cited

U.S. PATENT DOCUMENTS 4,290,662 A * 9/1981 Storcel ..... 339/89
5,199,894 A * 4/1993 Kalny et al. ..... 439/231

* cited by examiner

*Primary Examiner*—P. Austin Bradley
*Assistant Examiner*—Alexander Gilman
(74) *Attorney, Agent, or Firm*—William K. Bucher

(57) ABSTRACT

An electronic interconnect adapter for a bulkhead mounted high speed coaxial interconnect has a rotatable coupling bushing with a central bore. One side of the bushing has an axially extending flange disposed around the bore with the flange having a threaded interior surface that threadably mates with a threaded exterior surface of the female side of the coaxial interconnect. The opposite side of the bushing has an axially disposed cavity with a diameter greater than the central bore forming a shoulder within the cavity. A male side of the interconnect has a flange radially extending from a shield contact with a mating member extending through bore. A radial slot is formed in the cavity adjacent to the shoulder that receives a retaining member that captures the flange between the shoulder and the retaining member to secure the male side of the high speed coaxial interconnect to the coupling bushing.

8 Claims, 4 Drawing Sheets

BMA INTERCONNECT ADAPTER

BACKGROUND OF THE INVENTION

The present invention relates generally to interconnect adapters and more specifically to a BMA interconnect adapter using a bulkhead mountable BMA connector.

Electronic measurement equipment, such as oscilloscopes, spectrum analyzers, network analyzers and the like, and signal sources, such as arbitrary waveform generators, microwave generators and the like, use a variety of signal connectors for coupling signals into and out of the measurement equipment and signal sources. BNC connectors have a bayonet type connecting mechanism for securing the male side of the BNC connector to the female side of the connector. SMA, APC-7 and N-type connectors have threaded connecting mechanisms for securing the male side of the connectors to the female side. The female sides of the connectors have a threaded outer surfaces for receiving a threaded cowling on the male side of the connectors. The ends of the respective cowlings are equal with or extends past the end of the male connector. The threads on the inner surface of the cowling mate with the threads on the outer surface of the female side of the connector to secure the male side to the female side. The above described signal connectors are designed for hand attachment and detachment of the connectors. BNC type connectors are generally used to couple signals up to 4 Ghz. N-type connector and APC-7 connectors couple signals up to 18 Ghz. SMA connectors couple signals up to 26 Ghz.

BMA or blind mate connectors are another type of high frequency connector designed for coupling high frequency signals between bulkheads of modules without the use of threaded coupling or bayonet type connections. Referring to FIG. 1, there is shown a cross-section view of male 10 and female 12 sides of a BMA connector 14 mounted on respective bulkheads or panels 16, 18. The male side 10 of the BMA connector, such as manufactured and sold by M/A-Com Division of Amp, Inc., Lowell, Mass., includes a shield sleeve portion 20 having a tapered exterior portion 22 at the free end. The shield sleeve portion 20 has a threaded portion 24 disposed away from the free end that receives a retaining nut 26. A radially extending hexagonal flange 28 is formed on the shield sleeve portion 20 that abuts against the bulkhead or panel 16. Extending away from the flange 28 in an opposite direction from the free end is a second mating portion 30. The second mating portion 30 may be configured to receive a coaxial cable, formed as a SMA connector, or the like. The free end includes a central signal conductor 32 extends into the shield sleeve portion 20 and has a base portion 34, and an extending free end portion 36 coaxial with the shield sleeve portion 20. The free end portion 36 has a narrower diameter than the base portion, providing a shoulder 38 facing the leading direction. The free end of the conductor 36 is recessed below the shield portion 20 to prevent damage and to ensure that the shield 20 is connected when the signal conductor 32 makes and breaks contact.

A female side 12 of the BMA connector 14 has a cylindrical sleeve 40 defining a cylindrical chamber 42. The outer surface 44 of the cylindrical sleeve 42 is threaded to receive a retaining nut 46. A radially extending hexagonal flange 48 is formed on the cylindrical sleeve 40 that abuts against the bulkhead or panel 18. The sidewalls 50 and floor 52 of the chamber 40 are lined with a leaf spring sleeve having side springs 54 bowing slightly into the chamber 40, and end spring portions 56 bowing into the chamber 40 from the floor. The side springs 54 compliantly grip the male shield portion 20, even if it were somewhat angularly displaced. For the BMA standard, displacements of up to 5 degrees are tolerated without degradation of the connection. The end spring portions 56 provide compliant contact with the end surface 22 of the male shield 10, tolerating a small range of insertion depths, so that the signal connection may establish the precise insertion depth. A central signal conductor 58 is a rigid sleeve having a bore 60 sized to closely receive the free end portion 36 of the male side conductor 32. The conductor 58 has a free end surface 62 that is recessed at adequate depth below the free end face of the shield sleeve 40 to protect against damage. In addition, the sleeve 40 extends to an adequate distance relative to the signal conductor 58 to ensure that the shield contact is already made when the signal contact connects and is still made when the signal contact disconnects.

The male 10 and female 12 sides of the BMA connector 14 are inserted through holes 70, 72 in the respective bulkheads 16, 18 with the respective hexagonal flanges 28, 48 abutting against the bulkheads. Respective retaining nuts 26, 46 are threaded onto the male and female sides and tightened against the bulkheads to secure the male and female sides to the bulkheads. The bulkheads are brought together such that the shield sleeve portion 20 of the male side 10 is inserted into the chamber 40 of the female side 12 with the compliant springs 54 of the female side gripping the male shield sleeve portion 20 to align the free end portion 36 of the male signal conductor 32 to the bore 60 of the female central signal conductor 58. The bulkheads 16, 18 are secured together with screws, nuts and bolts and the like (not shown) to provide the axial thrust recommended by the manufacture for optimum signal integrity.

BMA connectors are used in applications where traditional threaded type connectors cannot be used, such as coupling high speed signals from a VXI module to a system backplane. However, they have not been used as part of a measurement instrument or signal source front panel until recently. Tektronix, Inc, Beaverton, Oreg., the assignee of the instant invention, introduced the TDS7104 Oscilloscope with a TEKCONNECT™ signal interconnect system using BMA connectors. The front panel of the oscilloscope has rectangular pockets with each pocket having one side of the BMA connector mounted therein. The other side of the BMA connector is mounted in the end of a rectangular body portion that contains circuitry associated with of a measurement probe, adapter connectors and the like. The body portion is inserted into the pocket portion with the two sides of the BMA connectors making contact. Mechanical latching elements in the pocket and body provide the axial thrust for securing the two sides together for optimum performance. The above described signal interconnect system is described in co-pending patent application titled "Electronic Interconnect Device for High Speed Siganl and Data Transmission", Ser. No. 09/716,080, filed Nov. 17, 2000.

What is needed is an adapter for a BMA connector that would allow the BMA connector to be used as a front panel connector. Such an adapter should be able to use existing BNA components. Further, the adapter should provide the axial thrust for a good connection without having to mount both sides of the BMA connector on bulkheads or panels. The adapter should also be easily attached and detached from the BMA front panel connector. The adapter should be of a small size so as not to require significant front panel space.

SUMMARY OF THE INVENTION

Accordingly, the present invention is to an electronic interconnect adapter for a bulkhead mounted high speed coaxial interconnect having a female side mounted on the bulkhead. The female side of the adapter has a central signal conductor and a coaxial shield sleeve defining a chamber having a compliant contact facility portion with the sleeve having a threaded exterior surface. The interconnect adapter has a male side of the high speed coaxial interconnect having a central signal conductor and a coaxial shield contact The shield contact is divided into first and second mating members by a radially extending flange disposed part way along the shield contact The male portion of the first mating member is flexibly gripped by the compliant contact facility portion of the female side chamber. The male side of the high speed coaxial interconnect is inserted through a central bore in a rotatable coupling bushing. One side of the bushing has an axially extending flange disposed around the bore with the flange having a threaded interior surface that threadably mates with the threaded exterior surface of the female side coaxial shield sleeve. The opposite side of the bushing has an axially disposed cavity with a diameter greater than the central bore forming a shoulder within the cavity that receives the flange on the shield contact. A radial slot is formed in the cavity adjacent to the shoulder that receives a retaining member that captures the flange between the shoulder and the retaining member to secure the male side of the high speed coaxial interconnect to the coupling bushing. The coupling bushing provides axial thrust of the first mating member into the chamber of the female side of the coaxial interconnect as the coupling bushing is threaded onto the coaxial shield sleeve.

In the preferred embodiment of the invention, the speed coaxial interconnect is a BMA connector. The second mating member on the male side of the speed coaxial interconnect may be adapted to receive a coaxial cable, formed as a SMA male interconnect, or the like. The flange is preferably an integrally formed and radially extending nut disposed part way along the shield contact and a circular washer having a diameter equal to or greater than the maximum diameter of the integrally formed nut with a central bore there through. The washer is positioned on the first mating member in abutting relationship with the integral nut. A retaining nut is threadably mounted on the threaded portion of the first mating member that secures the washer on the male side of the coaxial interconnect. Alternately, the nut and washer may be integrally formed on the coaxial shield contact of the male side of the coaxial interconnect. The coupling bushing is preferably circular in form having a knurled exterior surface. The objects, advantages and novel features of the present invention are apparent from the following detailed description when read in conjunction with the appended claims and attached drawings.

BRIEF DESCRIPTION OF THE DRAWING FIGURES

DETAILED DESCRIPTION OF THE PREFERRED EMBODIMENT

Figure 1:
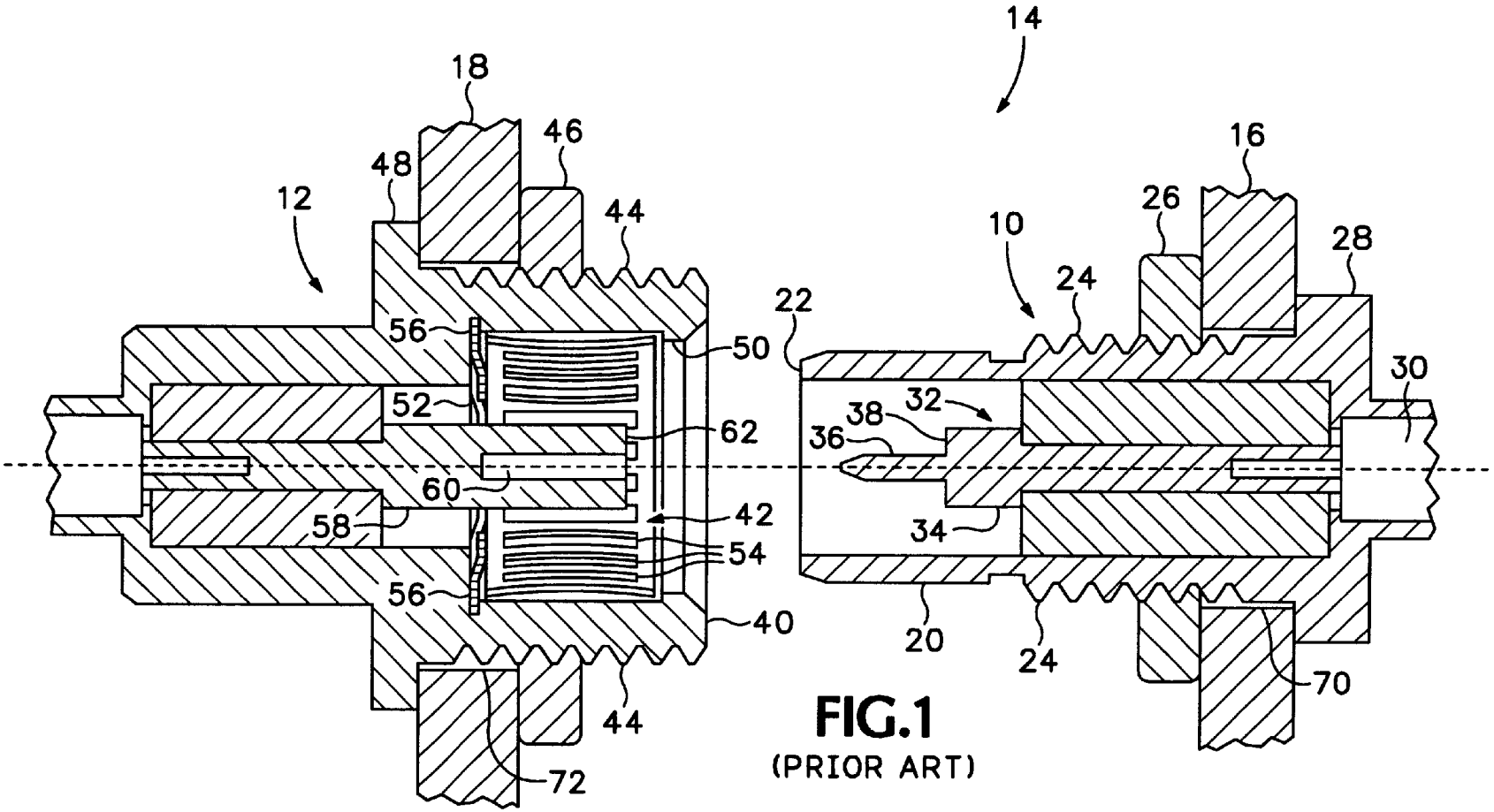
FIG.1 (PRIOR ART)
FIG. 1 is a cross-sectional view of a standard Bulkhead mounted BMA connector as used in the prior art.
Figures 2, 3:
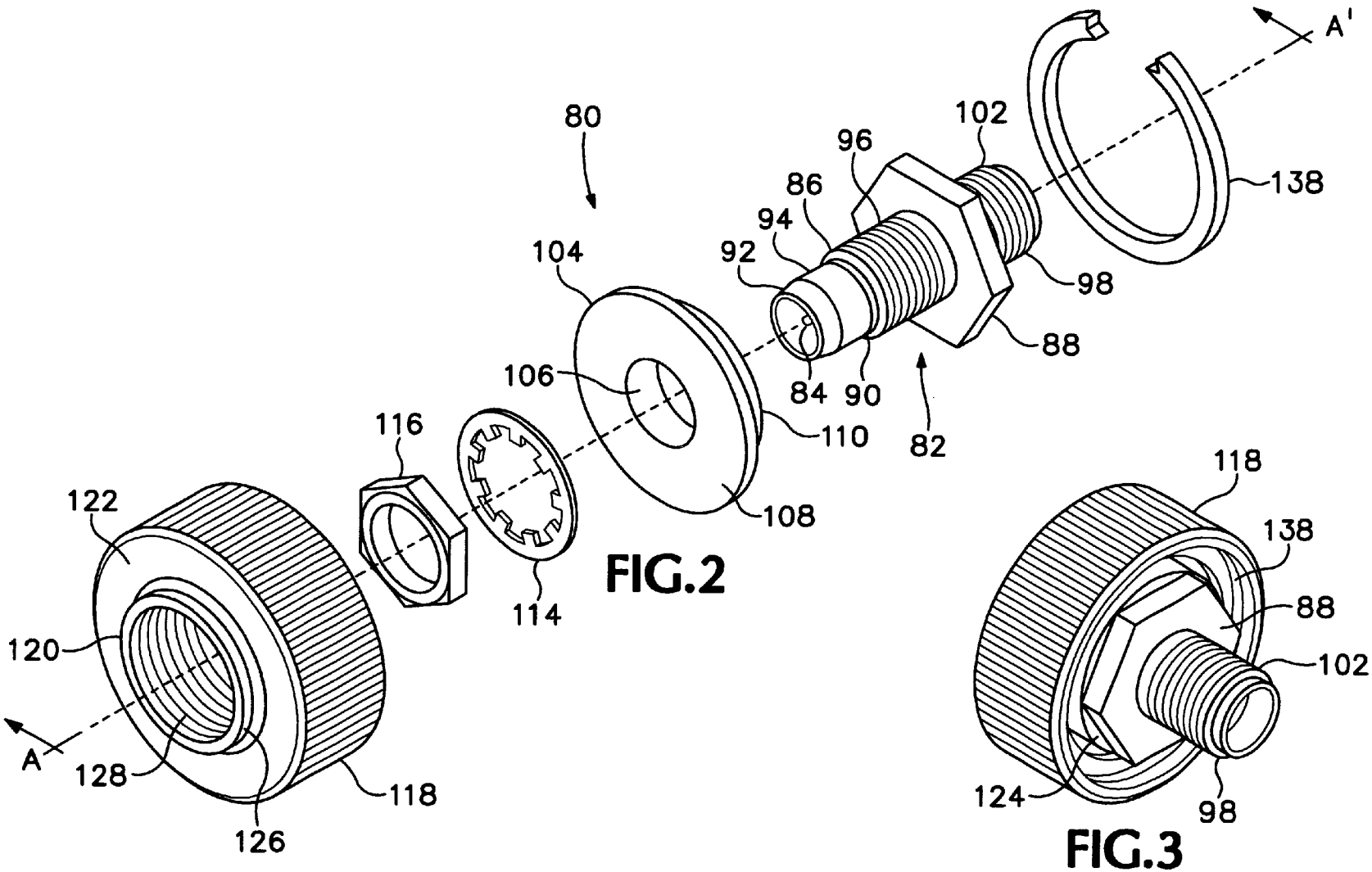
FIG. 2 is an exploded perspective view of the electronic interconnect adapter according to the present invention.
FIG. 3 is a reverse perspective view of the electronic interconnect adapter according to the present invention.
Figure 4:
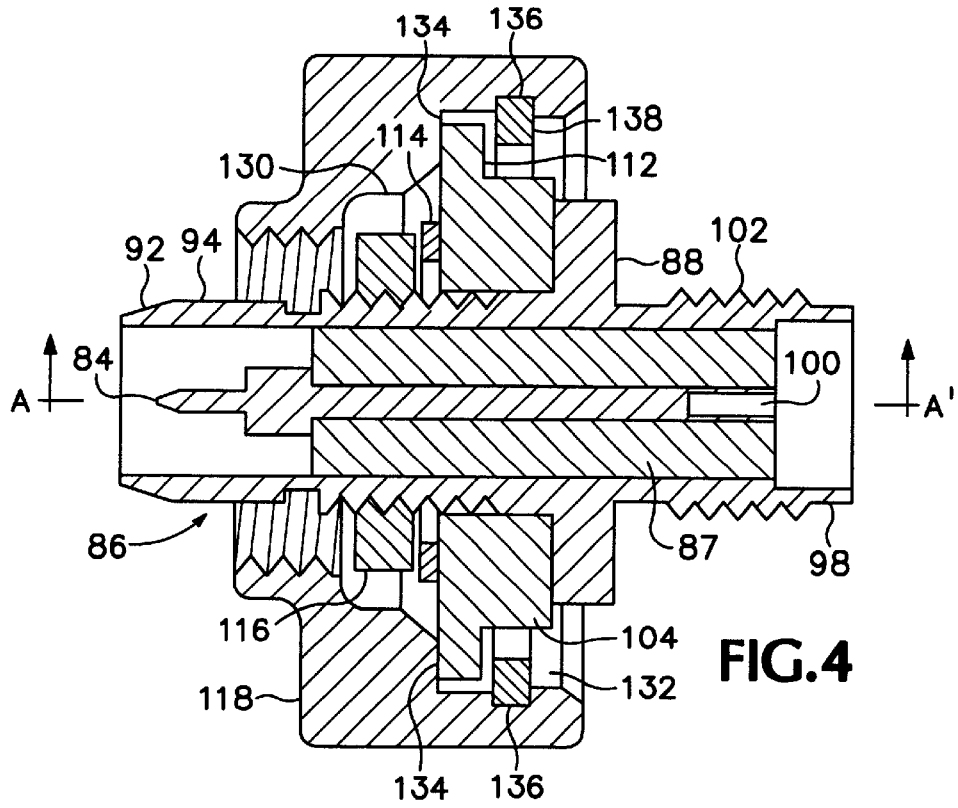
FIG. 4 is a cross-sectional view along line A–A' of the electronic interconnect adapter according to the present invention.

Referring to FIGS. 3 and 4, the interconnect adapter 80 has one side of a high speed coaxial interconnect in the form of a BMA connector 82, which in the preferred embodiment is the male side of the BMA connector, such as manufactured and sold by MWA-Com Division of Amp, Inc., Lowell, Mass., under Part No. 4585-2240-02. The male side of the BMA connector 82 has a central signal conductor 84 and a coaxial shield contact 86 separated by a dielectric insulating member 87. The exterior surface of the shield contact 86 has a radially extending flange 88 disposed part way along the contact 86. The flange 88 is hexagonal in shape for accepting a wrench or similar type of tool for securing the connect or to a bulkhead or panel. Extending in one direction from the flange is a BMA mating member 90. The shield contact 86 at the free end of the mating member 90 has a tapered end portion 92 and a smooth exterior surface 94. The smooth exterior surface 94 transitions into an threaded exterior portion 96 that extends to the flange. Extending from the opposite direction from the flange 88 is second mating member 98. The second mating member 98 may be configured to receive various types of connector or cables. In the instant drawing, the second mating member 98 is configured as a female side of a SMA connector. The SMA connector has a central signal conductor 100 (viewable in FIG. 4) and a threaded outer shield conductor 102 separated by the dielectric insulating member 87 that receives the treaded cowling of the male SMA connector.

A circular washer 104 having a central bore 106 there through is positioned on the BMA connector 82 from the BMA mating member side of the connector 82. The washer 104 has a first section 108 having a first diameter and a second section 110 having a slightly smaller diameter forming a shoulder 112 (viewed in FIG. 4) at the juxtapositon of the two sections. The smaller diameter section 110 is positioned against the flange 88. The first section 108 of the washer 104 radially extends past the flange 88 on the BMA connector 82. A lock washer 114 of common design is placed on the BMA connector 82 and positioned against the washer 104. A nut 116 is threaded onto the shield contact 86 of the mating member 90 and tightened against the lock washer 114 to secure the washer 104 onto the BMA connector 82.

The assembled BMA connector 82 is inserted into a rotatable coupling bushing 118. The rotatable coupling bushing 118 has a central bore 120 that receives the BMA connector 82. The bushing 118 is circular in shape and has a flat surface 122 on one side and a cavity 124 formed in the other side. An axially extending flange 126 extends from the flat surface 122 around the central bore 120. The interior surface 128 of the flange is threaded for threading onto the outer surface 44 of the cylindrical sleeve of the female side of the BMA connector 12 that is mounted on a front panel of an electronic instrument The cavity 124 has a diameter greater than the central bore 120 sufficient to receive the washer 104, lock washer 114 and nut 116. In the preferred embodiment, the cavity 124 has a first region 130 of sufficient diameter to receive the nut 116. The first region transitions to a second region 132 of sufficient diameter to receive the washer 104 and lock washer 114. The transition from the first to second regions 130 and 132 forms a shoulder 134 on which the washer 104 abuts. A radial slot 136 is formed in the cavity adjacent to the shoulder 134 that receives a retaining member 138, such as a retaining ring or the like. The retaining member 138 captures the washer 104 between the shoulder 134 and the member 138 to secure the assembled BMA connector 82 within the rotatable coupling bushing 118.

The rotatable coupling bushing 118 has an overall diameter of 0.750 inches and an overall width of 0.350 inches. The central bore 120 has a threaded diameter of 0.375 inches with the axially extending flange 126 having a length of 0.100 inches. The cavity 124 has an overall length of 0.245 inches with the first region 130 of the cavity having a length of 0.097 inches and a diameter of 0.450 inches. The second region 132 of the cavity has a length of 0.148 inches and a diameter of 0.625 inches. The radial slot 138 has a width of 0.039 inches and a diameter of 0.650 inches. The outer surface of the bushing is preferably knurled for easy gripping. The washer 104 has an overall diameter of 0.600 inches and an overall width of 0.115 inches. The first section 108 of the washer 104 has a thickness of 0.040 inches. The second section 110 of the washer 104 has a diameter of 0.490 inches and a thickness of 0.075 inches. The diameter of the central bore 106 is 0.245 inches. As with any mechanical device, the dimensions given are the nominal values. Each respective value has associated plus and minus tolerance values. Further, the dimensions given are exemplary in nature and other dimensions may be used without departing from the scope of the invention.

The electronic interconnect adapter 80 is placed onto the female side 12 of the BMA 14 connecter that is bulkhead mounted onto the front panel of electronic equipment, such as a measurement instrument, signal source or the like. The interior threads 128 of the axially extending flange 126 engage the exterior threads 44 of the cylindrical sleeve 40 of the female side 12 of the BMA connector. The coupler bushing 118 is rotated in a clockwise direction to thread the bushing 118 onto the female side 12 of the BMA connector. Continued clockwise threading of the bushing 118 forces the male BMA mating member 90 into the chamber 40 of the female BMA connector with the compliant springs 54 of the female side gripping the male shield contact 86 to align the signal conductor 84 to the bore 60 of the female central signal conductor 58. As the bushing is placed and threaded onto the female side 12 of the BMA connector, the washer 104 is forced against the retaining member 138. As the interconnect adapter is screwed on the female side 12 of the BMA connector, the coupling bushing 118 provides the axial thrust for inserting the male BMA mating member 90 into the chamber 40 of the female side 12 of the BMA connector. The axial thrust provided by the adapter 80 assures a good connection between the male and female sides of the BMA connectors.

Figure 5:
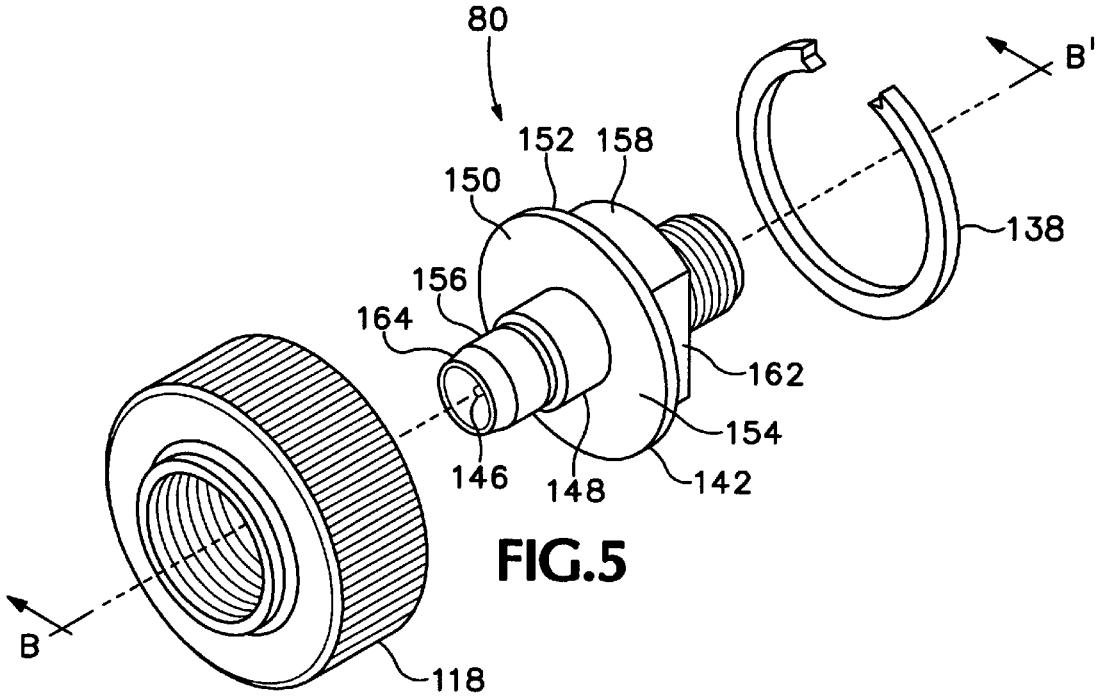
FIG. 5 is an exploded perspective view of a further embodiment of the electronic interconnect adapter according to the present invention.
Figure 6:
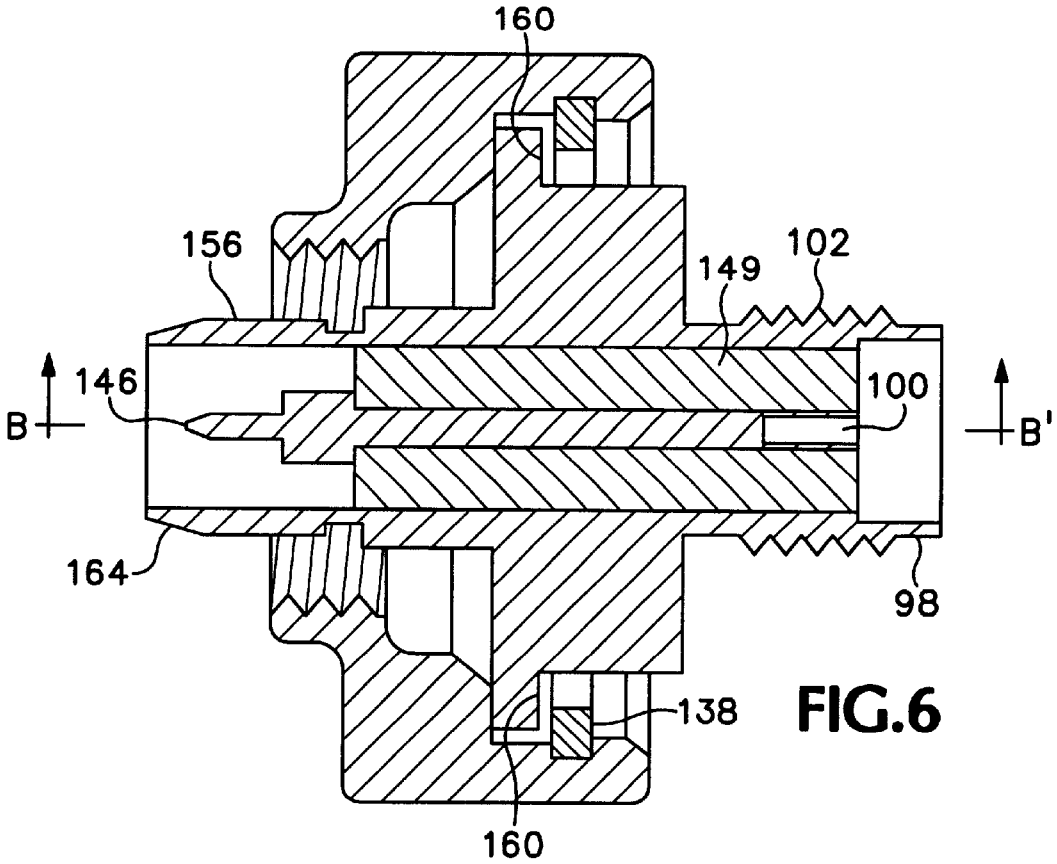
FIG. 6 is a cross-sectional view along line B–B' of the further embodiment of the electronic interconnect adapter according to the present invention.

Referring to FIGS. 5 and 6, there is shown an exploded perspective view and a cross-section view along line B–B' of a further embodiment of the electronic interconnect adapter 80 of the present invention. The interconnect adapter 80 in this embodiment includes the rotatable coupling bushing 118, a modified BMA connector 142 and the retaining member 138. The modified BMA connector 142 has central signal conductor 146 and a coaxial shield conductor 148 separated by dielectric insulating member 149. A radially extending and integrally formed flange 150 is disposed partway along the shield conductor 148 and performs the function of the flange 88 and the washer 104 in the previous embodiment. The flange 150 has a first section 152 having a first diameter. The first section 152 of the flange 150 has a flat surface 154 facing the BMA mating member 156. The flange 150 has an integrally formed second section 158 having a diameter smaller than the diameter of the first section 152 that faces the SMA second mating member 98. The interface between the two sections 152 and 158 forms a shoulder 160. The second section 158 has opposing flat surfaces 162 formed thereon for accepting a wrench or similar type of tool. The shield conductor 148 of the BMA mating member 156, extending from the flange 150, has a tapered end portion 164 and a smooth portion. Absent from BMA mating member 152 is the threaded portion 96 described in the previous embodiment Since the flange 150 is integrally formed with shield conductor 148, there is no need for the lock washer 114 and nut 116 for securing the washer 104 against the flange.

The modified BMA connector 142 has the same overall dimensions with the exception of the radially extending flange 150. The diameter and thickness of the first section 152 of the flange 150 is the same as that of the washer 104. The second section 158 of the flange 150 has same diameter as the second section 110 of the washer 104 and the flange 88 with a thickness of 0.142 inches. Assembly of the interconnect adapter 80 requires inserting the modified BMA connector 142 into the rotatable coupling bushing 118 with the shoulder 160 abutting the shoulder 134 in the cavity 124. The connector 142 is secured the bushing 118 with the retaining member 138.

Figure 7:
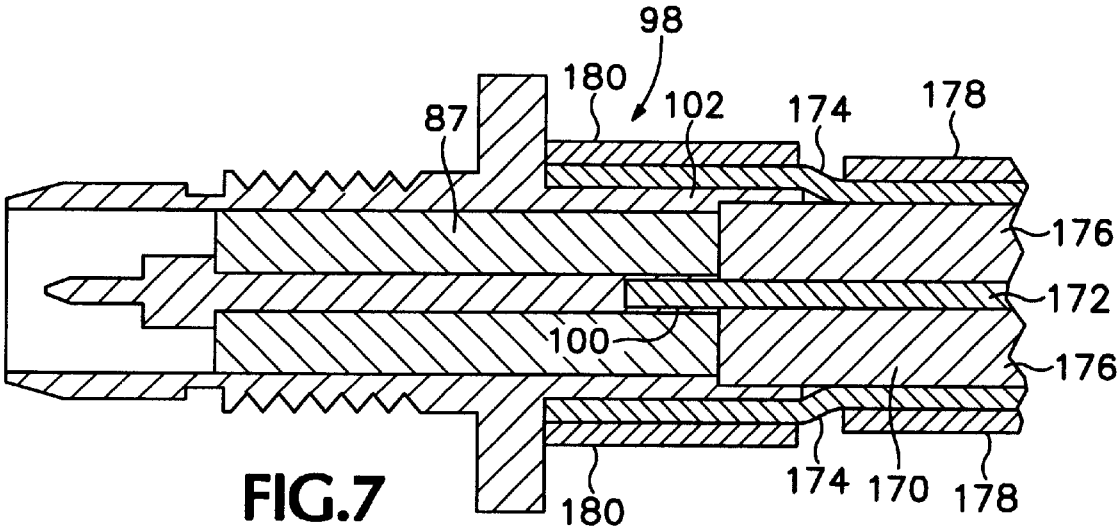
FIG. 7 is a side-sectional view of a BNA connector adapted to receive a coaxial cable usable in the electronic interconnect adapter according to the present invention.

As was previously mention, the second mating member 98 may be configured to accept various types of cables and connectors. FIG. 7 show one example of a second mating 98 configured to accept a flexible coaxial cable 170. The coaxial cable has a center conductor 172 and an outer shielding conductor 174 that are separated by an insulating dielectric 176. The outer shield conductor 174 is generally formed of braided wires, but braided foil strips, wrapped foil strips and the like may also be used. The outer shielding conductor 174 is covered by an outer insulating layer 178. The second mating member 98 has the female central signal conductor 100 and the outer shield conductor 102 separated by the dielectric insulating material 87. The outer shielding conductor 102 has a smooth outer surface as opposed to the SMA mating member that has a threaded outer surface.

The coaxial cable 170 is prepared for connection to the second mating member 98 by removing a portion the outer insulating layer 178. The outer shielding conductor 174 is folded back to expose the insulating dielectric 176. A portion of the insulating dielectric 176 is removed to expose the end portion of the central conductor 172. The end portion of the central conductor 172 is inserted into the female central signal conductor 100 of the second mating member 98 with the insulating dielectric 176 abutting the dielectric insulating material 87 in the mating member 98. The outer shielding conductor 174 is placed over the outer shielding conductor 102 and secured to the mating member by an attachment member 180, such as a metal bushing crimped onto the shielding conductor 102 or heat shrinking an adhesive coated heat shrinkable material onto the shielding conductor 102.

An electronic interconnect adapter for a bulkhead mountable high speed coaxial interconnect has been described having a male side of the high speed coaxial interconnect, a rotatable coupling bushing and a retaining member. The male side of the interconnect has a central signal conductor and a coaxial shield contact with the contact being divided into first and second mating members by a radially extending flange disposed part way along the shield contact. The male side of the high speed coaxial interconnect is inserted through a central bore in a rotatable coupling bushing. One side of the bushing has an axially extending flange disposed around the bore with the flange having a threaded interior surface. The opposite side of the bushing has an axially disposed cavity with a diameter greater than the central bore forming a shoulder within the cavity that receives the flange on the shield contact. A radial slot is formed in the cavity adjacent to the shoulder that receives a retaining member that captures the flange between the shoulder and the retaining member to secure the male side of the high speed coaxial interconnect to the coupling bushing. The coupling bushing provides axial thrust of the first mating member into a chamber of the female side of the coaxial interconnect that is bulkhead mounted on a front panel of a electronic instrument. The female side of the high speed coaxial interconnect includes a coaxial shield sleeve having a chamber with a compliant contact facility portion that flexibly grips the first mating member as the coupling bushing is threaded onto the coaxial shield sleeve.

It will be obvious to those having skill in the art that many changes may be made to the details of the above-described embodiments of this invention without departing from the underlying principles thereof. The scope of the present invention should, therefore, be determined only by the following claims.

What is claimed is:

1. An electronic interconnect adapter for a bulkhead mounted high speed coaxial interconnect having a female side mounted on the bulkhead and including a central signal conductor and a coaxial shield sleeve defining a chamber having a compliant contact facility portion with the sleeve having a threaded exterior surface comprising:

a male side of the high speed coaxial interconnect having a central signal conductor and a coaxial shield contact with the shield contact being divided into first and second mating members by an integrally formed and radially extending nut disposed part way along the shield contact with the first mating member having a threaded portion disposed between the nut and a mating portion having threads formed on the exterior surface thereof with the compliant contact facility portion of the female side chamber flexibly gripping the mating portion of the first mating member;

a circular washer having a central bore there through and a diameter equal to or greater than the maximum diameter of the integrally formed nut positioned on the first mating member in abutting relationship with the integral nut;

a retaining nut threadably mounted on the threaded portion of the first mating member that secures the washer on the male side of the coaxial interconnect;

a rotatable coupling bushing having a central bore that receives the male side of the high speed coaxial interconnect with one side of the bushing having an axially extending flange disposed around the bore with the flange having a threaded interior surface that threadably mates with the threaded exterior surface of the female side coaxial shield sleeve and the opposite side of the bushing having an axially disposed cavity with a diameter greater than the central bore forming a shoulder within the cavity that receives the circular washer on the shield contact and a radial slot formed in the cavity adjacent to the shoulder; and a retaining member disposed in the radial slot that captures the circular washer between the shoulder and the retaining member to secure the male side of the high speed coaxial interconnect to the coupling bushing whereby the coupling bushing provides axial thrust of the first mating member into the chamber of the female side of the coaxial interconnect as the coupling bushing is threaded onto the coaxial shield sleeve.

2. The electronic interconnect adapter as recited in claim 1 wherein the second mating member is a SMA female interconnect.

3. The electronic interconnect adapter as recited in claim 1 wherein the second mating member is adapted to receive a coaxial cable.

4. The electronic interconnect adapter as recited in claim 1 wherein the coupling bushing is circular in form having a knurled exterior surface.

5. An electronic interconnect assembly comprising:

a high speed coaxial interconnect having a central signal conductor and a surrounding shield conductor with the interconnect having a male side and a female side;

the female side being mountable on a bulkhead and including a central signal conductor and a coaxial shield sleeve defining a chamber having a compliant contact facility portion with the sleeve having a threaded exterior surface;

the male side of the high speed coaxial interconnect having a central signal conductor and a coaxial shield contact with the shield contact being divided into first and second mating members by an integrally formed and radially extending nut disposed part way along the shield contact with the first mating member having a threaded portion with threads formed on the exterior surface thereof disposed between the nut and a mating portion with the compliant contact facility portion of the female side chamber flexibly gripping the mating portion of the first mating member;

a circular washer having a central bore there through and a diameter equal to or greater than the maximum diameter of the integrally formed nut positioned on the first mating member in abutting relationship with the integral nut;

a retaining nut threadably mounted on the threaded portion of the first mating member that secures the washer on the male side of the coaxial interconnect;

a rotatable coupling bushing having a central bore that receives the male side of the high speed coaxial interconnect with one side of the bushing having an axially extending flange disposed around the bore with the flange having a threaded interior surface that threadably mates with the threaded exterior surface of the female side coaxial shield sleeve and the opposite side of the bushing having an axially disposed cavity with a diameter greater than the central bore forming a shoulder within the cavity that receives the circular washer on the shield contact and a radial slot formed in the cavity adjacent to the shoulder; and a retaining member disposed in the radial slot that captures the circular washer between the shoulder and the retaining member to secure the male side of the high speed coaxial interconnect to the coupling bushing whereby the coupling bushing provides axial thrust of the first mating member into the chamber of the female side of the coaxial interconnect as the coupling bushing is threaded onto the coaxial shield sleeve.

6. The electronic interconnect assembly as recited in claim 5 wherein the second mating member is a SMA female interconnect.

7. The electronic interconnect assembly as recited in claim 5 wherein the second mating member is adapted to receive a coaxial cable.

8. The electronic interconnect assembly as recited in claim 5 wherein the coupling bushing is circular in form having a knurled exterior surface.

* * * * *